US011065752B2

(12) United States Patent
Hu et al.

(10) Patent No.: US 11,065,752 B2
(45) Date of Patent: Jul. 20, 2021

(54) STAPLE GUN

(71) Applicant: APEX MFG. CO., LTD., Taichung (TW)

(72) Inventors: Chih-Wei Hu, Taichung (TW); Pei-Hung Cheng, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 269 days.

(21) Appl. No.: 16/222,084

(22) Filed: Dec. 17, 2018

(65) Prior Publication Data

US 2020/0189084 A1 Jun. 18, 2020

(51) Int. Cl.
*B25C 5/16* (2006.01)

(52) U.S. Cl.
CPC ..... *B25C 5/1696* (2013.01); *B25C 5/162* (2013.01)

(58) Field of Classification Search
None
See application file for complete search history.

(56) References Cited

U.S. PATENT DOCUMENTS 2,251,833 A * 8/1941 Polzer ..... B25C 5/1696 227/127
2,512,172 A * 6/1950 Olney ..... B25C 5/1696 227/125
2,801,414 A * 8/1957 Mueller ..... B25C 5/1696 227/127
2,979,725 A * 4/1961 Wandel ..... B25C 1/044 227/2
4,113,164 A * 9/1978 Muthenthaller ..... B25C 5/0292 227/124
4,724,992 A * 2/1988 Ohmori ..... B25C 1/005 227/132
5,497,931 A * 3/1996 Nakamura ..... B25C 5/0242 227/109
5,765,742 A * 6/1998 Marks ..... B25C 5/11 227/120
2015/0158162 A1* 6/2015 Dhillon ..... B25C 5/1617 227/132
2018/0207779 A1* 7/2018 Marks ..... B25C 5/1696

FOREIGN PATENT DOCUMENTS

FR 2416769 A1 * 9/1979 ..... B25C 5/1696
GB 1234011 A * 6/1971 ..... B25C 5/0292

* cited by examiner

*Primary Examiner* — Hemant Desai
*Assistant Examiner* — Tanzim Imam
(74) *Attorney, Agent, or Firm* — Muncy, Geissler, Olds & Lowe, P.C.

(57) ABSTRACT

A staple gun is provided, including: a main body, including a bottom side, and an abutting portion, a staple outlet and a notch which are disposed on the bottom side; a staple magazine, being withdrawably received within the main body; a lock mechanism, including a pressed member disposed on the staple magazine and having a restricting portion movable between a restricting position and a releasing position; wherein when the restricting portion is in the restricting position, the pressed member is located within the notch, the restricting portion is blocked with the abutting portion and the staple magazine is non-withdrawable from the main body; when the pressed member is pressed and moved toward an interior of the main body and the restricting portion is in the releasing position, the restricting portion is unlocked from the abutting portion and the staple magazine is withdrawable from the main body.

10 Claims, 6 Drawing Sheets

STAPLE GUN

BACKGROUND OF THE INVENTION

Field of the Invention

The present invention relates to a staple gun.

Description of the Prior Art

A conventional staple gun includes a main body and a staple magazine disposed on a bottom side of the main body, the staple magazine is lockable, by a lock mechanism, with an interior of the main body, and the lock mechanism includes an operation member which can be operated to unlock the staple magazine to allow withdrawal of the staple magazine from the main body. However, for the conventional staple gun, the staples are loaded from the bottom side, the press direction of the operation member of the lock mechanism is opposite to the staple-loading direction (bottom up), such that when the staples are loaded, mis-installation of the staples can occur often. Additionally, the conventional staple gun further includes an elastic member disposed between the main body and the staple magazine, for pushing the staples. As a result, when the lock mechanism is released, the staple magazine ejects strongly and quickly from the main body, it can cause injury to the user staple magazine or damage to the staple gun.

The present invention is, therefore, arisen to obviate or at least mitigate the above-mentioned disadvantages.

SUMMARY OF THE INVENTION

The main object of the present invention is to provide a staple gun, which can avoid mis-installation of staples.

To achieve the above and other objects, the present invention provides a staple gun, including: a main body, including a bottom side, and an abutting portion, a staple outlet and a notch which are disposed on the bottom side; a staple magazine, being withdrawably received within the main body; a lock mechanism, including a pressed member disposed on the staple magazine, the pressed member having a restricting portion which is movable between a restricting position and a releasing position; wherein when the restricting portion is in the restricting position, the pressed member is located within the notch, the restricting portion is blocked with the abutting portion and the staple magazine is non-withdrawable from the main body; when the pressed member is pressed and moved toward an interior of the main body and the restricting portion is in the releasing position, the restricting portion is unlocked from the abutting portion and the staple magazine is withdrawable from the main body.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
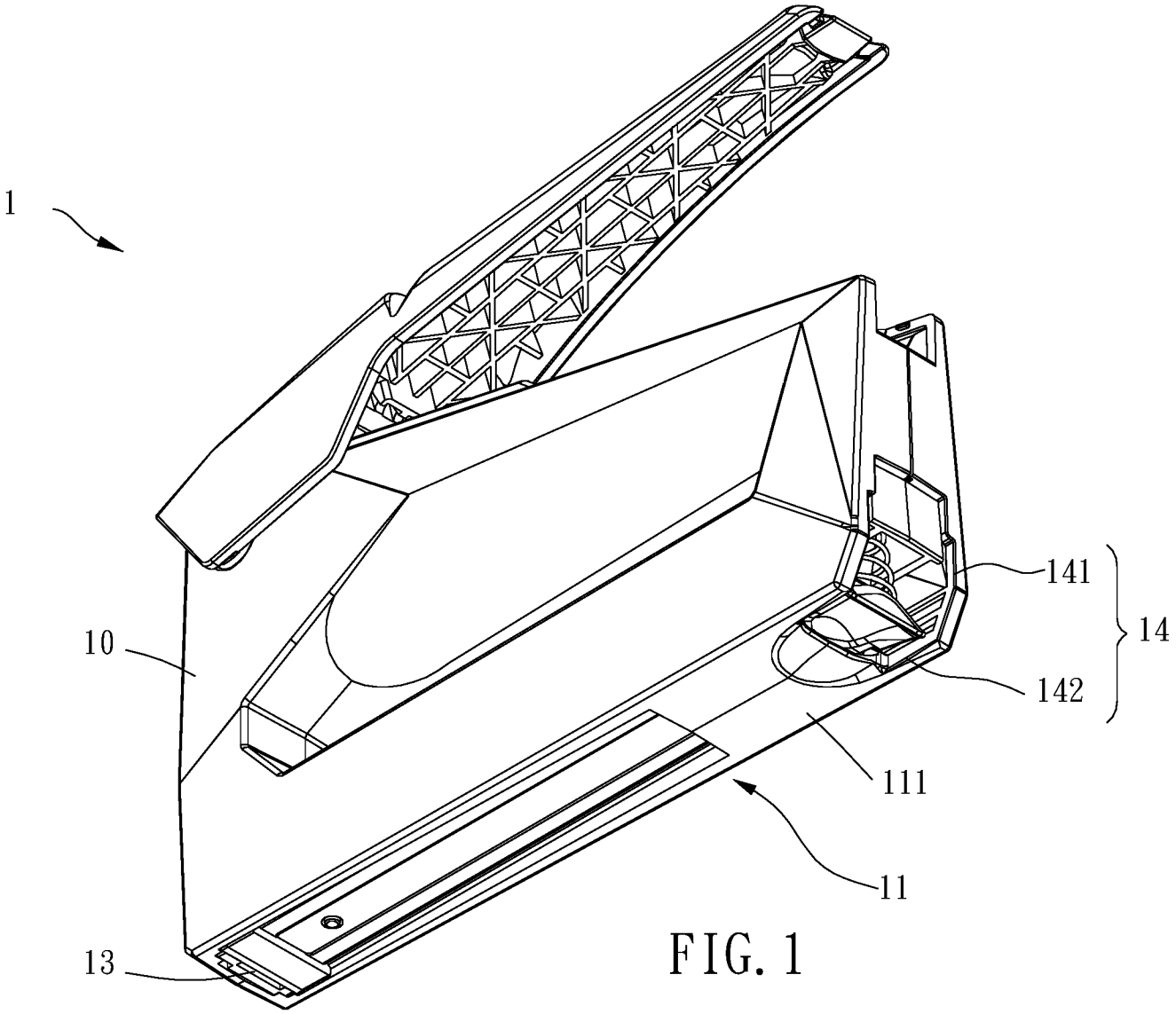
FIG. 1 is a stereogram of a preferable embodiment of the present invention.
Figure 2:
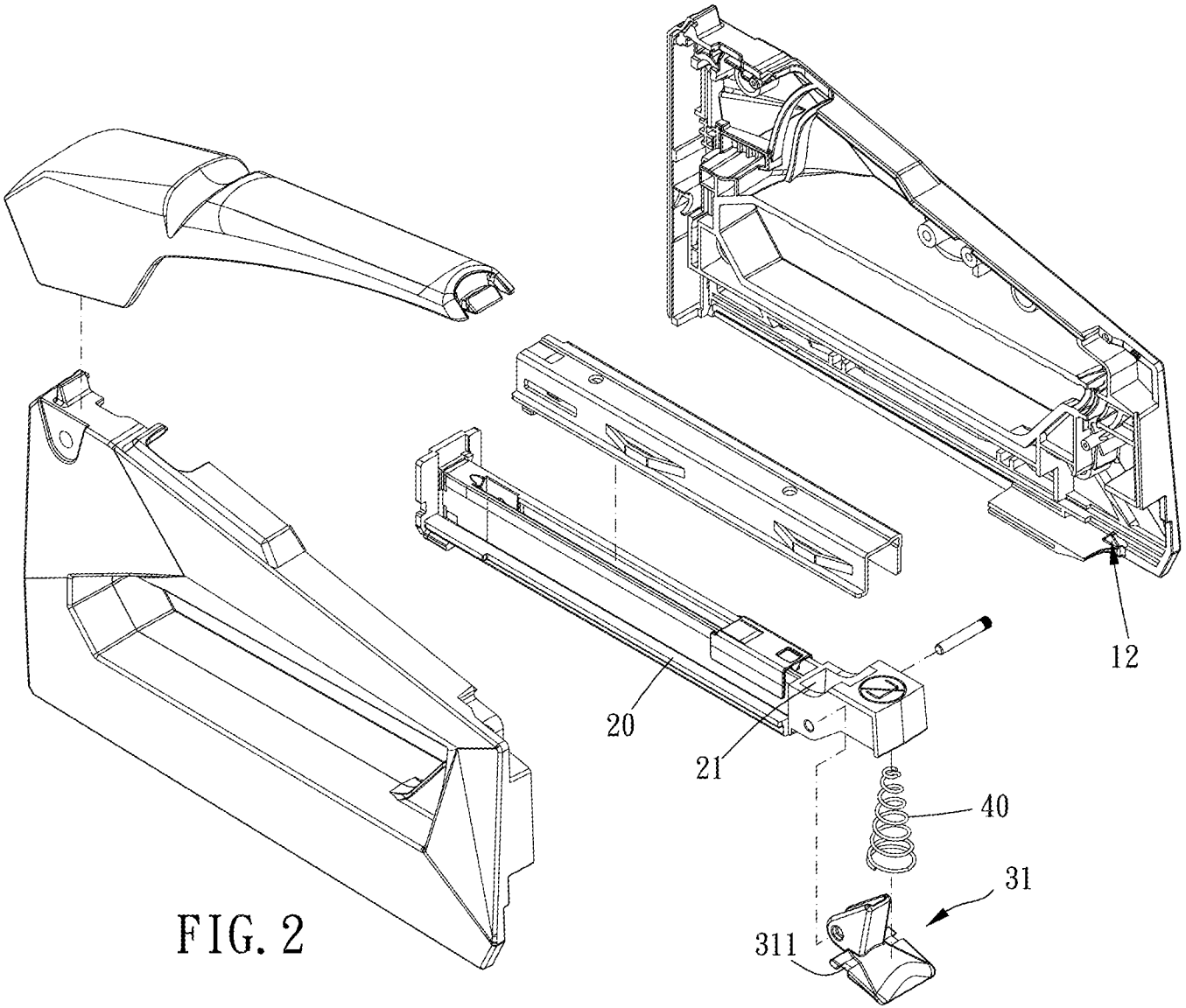
FIG. 2 is a breakdown drawing of a preferable embodiment of the present invention.

Please refer to FIGS. 1 to 7 for a preferable embodiment of the present invention. A staple gun 1 of the present invention includes a main body 10, a staple magazine 20 and a lock mechanism 30.

The main body 10 includes a bottom side 11, and an abutting portion 12, a staple outlet 13 and a notch 14 which are disposed on the bottom side 11; the staple magazine 20 is withdrawably received within the main body 10; the lock mechanism 30 includes a pressed member 31 disposed on the staple magazine 20, the pressed member 31 includes a restricting portion 311 which is movable between a restricting position and a releasing position; wherein, when the restricting portion 311 is in the restricting position, the pressed member 31 is located within the notch 14, the restricting portion 311 is blocked with the abutting portion 12 and the staple magazine 20 is non-withdrawable from the main body 10; when the pressed member 31 within the notch 14 is pressed and moved toward an interior of the main body 10 and the restricting portion 311 is in the releasing position, the restricting portion 311 is unlocked from the abutting portion 12 and the staple magazine 20 is withdrawable from the main body 10. Whereby, the lock mechanism 30 is naturally operated with the bottom side 11 facing upward to withdraw the staple magazine 20, and it ensures that the staples can always be accurately loaded in right direction.

Figure 3:
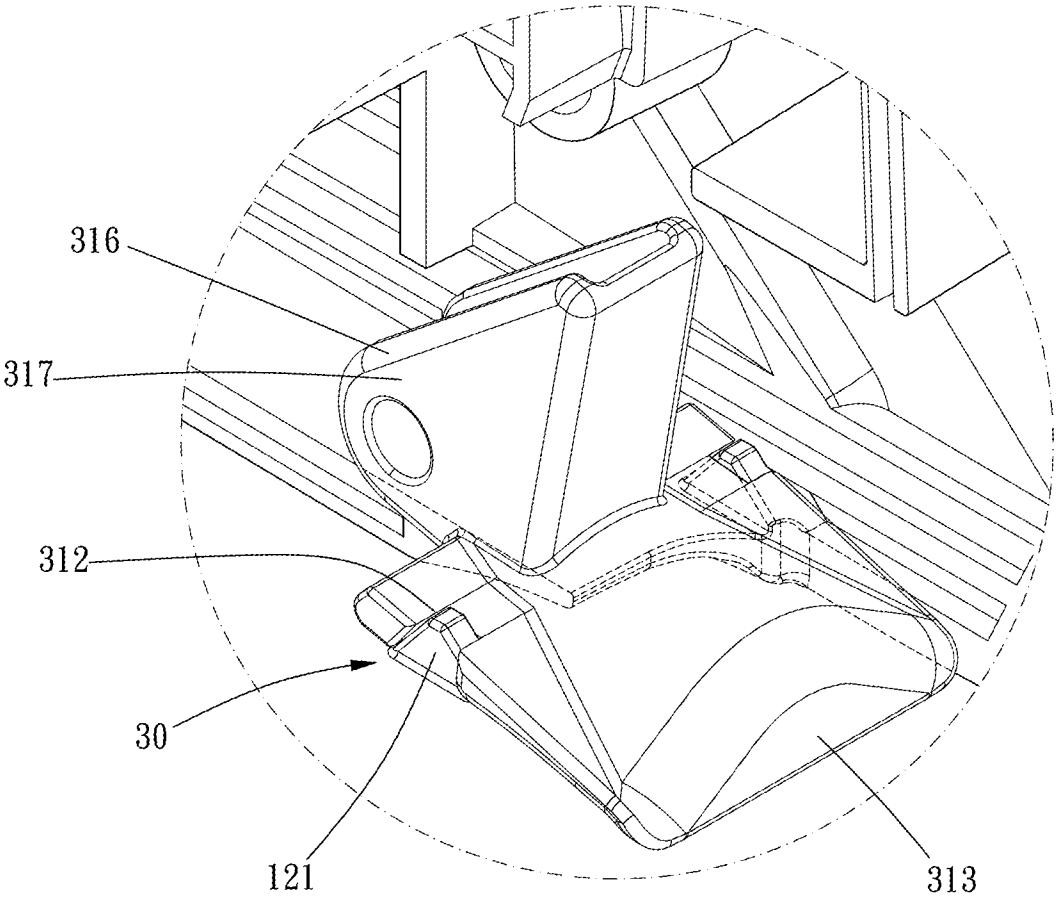
FIG. 3 is a partial enlarged drawing of a preferable embodiment of the present invention.
Figure 4:
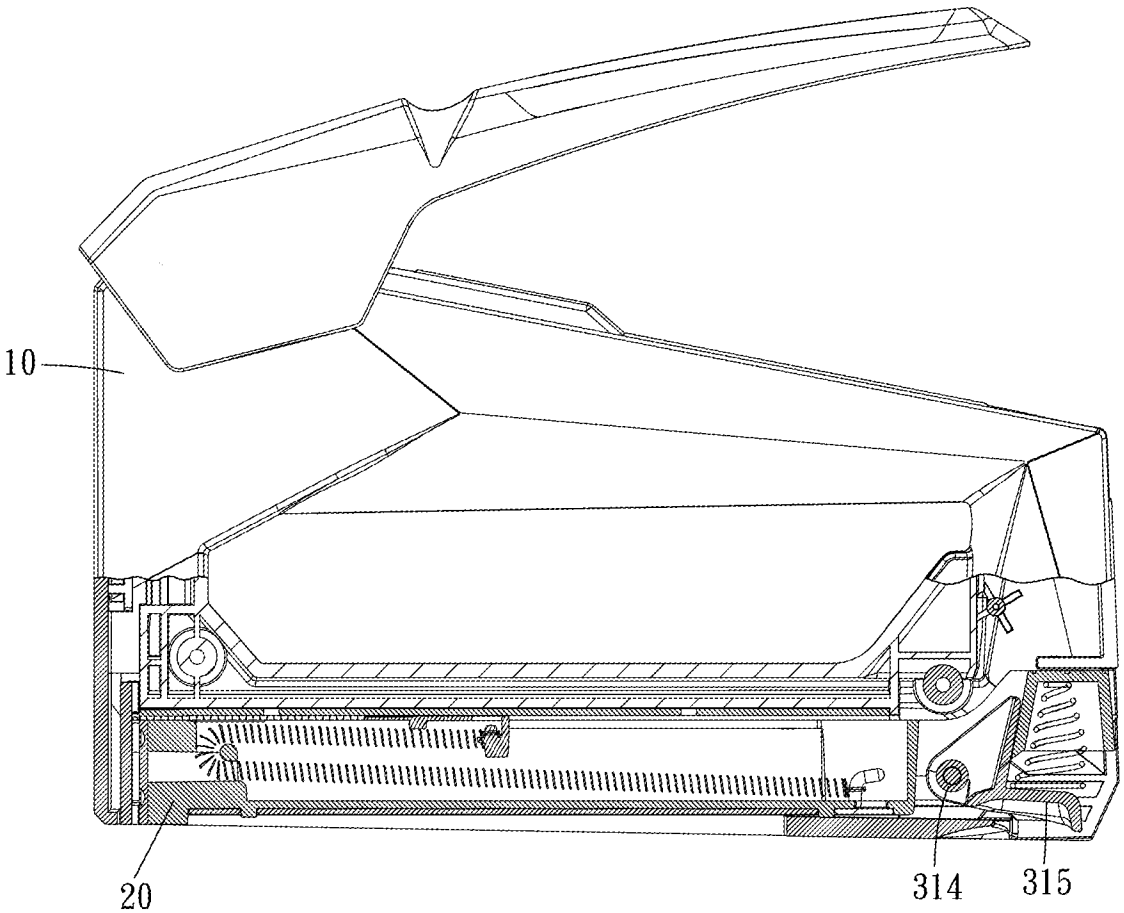
FIG. 4 is a partial cross-sectional view of a preferable embodiment of the present invention.

In this embodiment, the abutting portion 12 projects from an inner face of the bottom side 11 (may be integrally formed); the abutting portion 12 includes two protrusions 121 located at two corresponding sides of the staple magazine 20, and the restricting portion 311 includes two recesses 312 which are located at two corresponding sides of the pressed member 31 and engageable with the two protrusions 121, thus providing stable engagement, as shown in FIG. 3. Each recess 312 may be a notch or slot, or the like. However, the abutting portion and the restricting portion may be any mechanism, such as protrusion, arm, shoulder or the like, which can provide lock function. The two recesses are disposed on the abutting portion, and the two protrusions are disposed on the restricting portion.

The notch 14 disposed on the bottom side 11 is open in a direction away from the staple outlet 13, and thus the pressed member 31 can be pressed without obstacle. Specifically, the bottom side 11 includes an outermost bottom wall 111 having the staple outlet 13 disposed therethrough, and the notch 14 includes a first opening side 141 open in a direction away from the staple outlet 13 and a second opening side 142 opened on the outermost bottom wall 111. A staple direction D is defined from the interior of the main body 10 toward the staple outlet 13, and the pressed member 31 is partially exposed from the second opening side 142 and is pressable through the second opening side 142 to move in a direction opposite to the staple direction D. The pressed member 31 is rotatably attached to the staple magazine 20 and further includes a push member 313 exposed from the notch 14, the restricting portion 311 extends beside an inner side of the bottom side 11, and the push member 313 and restricting portion 311 are located at the same side relative to a pivot point 314 the pressed member 31. When the staples are loaded, the bottom side 11 faces upward and the push member 313 is pressed to the staple magazine 20. Since the press of the push member 313 and the loading of the staples are carried out in the same direction, thus avoiding mis-installation of the staples. The push member 313 preferably includes a concave surface 315 for easy grip to pull out the staple magazine 20. In other embodiments, the pressed member may be integrally formed as a part of the main body or may be disposed on the staple magazine and configured to be movable toward the interior of the main body; in such a case, when the pressed member within the notch is pressed to linearly move or swing toward the interior of the main body, the restricting portion can be driven to locate in the releasing position so that the staple magazine is withdrawable from the main body.

The staple magazine 20 includes a through channel 21, and the pressed member 31 is rotatably disposed within the through channel 21. The pressed member 31 further includes an urge portion 316 extending oppositely to the push member 313, the interior of the main body 10 further includes a block portion 15, the urge portion 316 is located between the abutting portion 12 and the block portion 15, and the block portion 15 is located on a rotation path of the urge portion 316. When the pressed member 31 is pressed toward the interior of the main body 10, the urge portion 316 pushes the block portion 15 to drive the staple magazine 20 to withdraw rearward from the main body 10 for easy pull of the staple magazine 20. Preferably, the urge portion 316 includes two side walls 317 disposed on two corresponding sides of the push member 313. When the two side walls 317 contact the block portion 15, the restricting portion 311 is disengaged from the abutting portion 12. The contact of the two side walls 317 and the block portion 15 can smooth the operation of the push member 313 with high stability and low frictional resistance.

The staple magazine 20 further includes a wall 22 therewithin, the pressed member 31 further includes a stop portion 318, and when the restricting portion 311 is located in the restricting position, the stop portion 318 is abutted against the wall 22, thus avoiding overswinging of the pressed member 31 and/or damaging of parts. The staple gun 1 preferably further includes an elastic member 40 disposed between the staple magazine 20 and the pressed member 31 so that the restricting portion 311 is normally located in the restricting position. In this embodiment, the staple magazine 20 further incudes a receiving room 23 open toward the pressed member 31, the wall 22 is disposed at an outer side of the receiving room 23 which is adjacent to the stop portion 318, and the elastic member 40 is received within the receiving room 23. In other embodiment, the staple magazine may be provided without the receiving room but may have the wall which is engageable with the stop portion.

Figure 5:
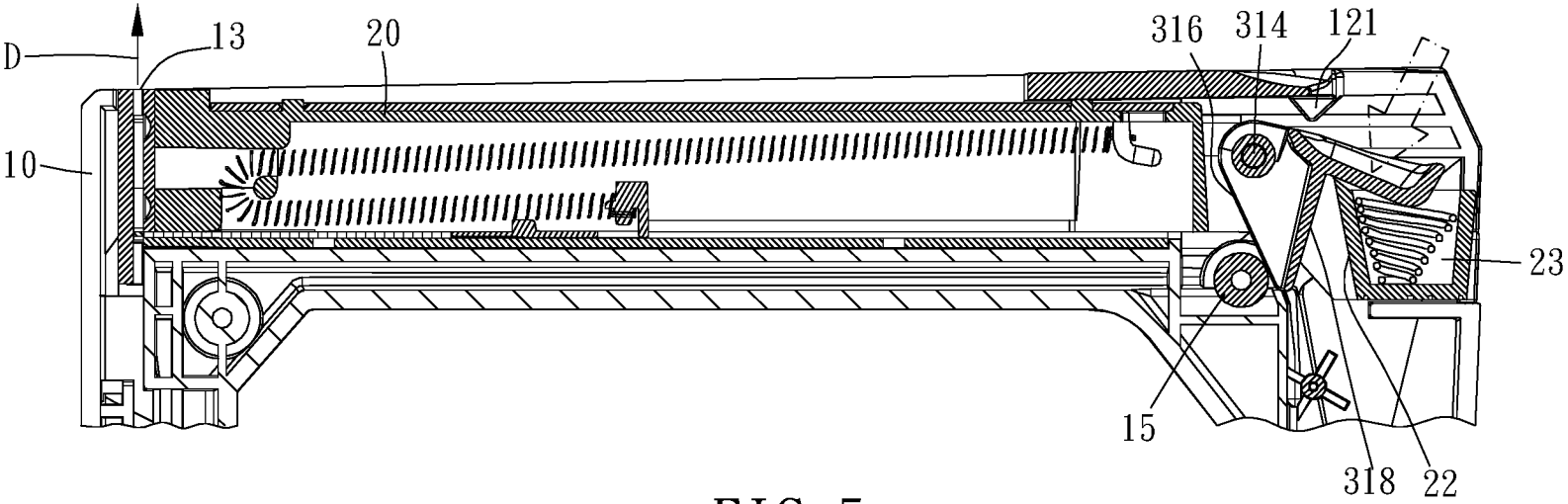
FIGS. 5-7 are drawings showing operation of a preferable embodiment of the present invention.
Figure 6:
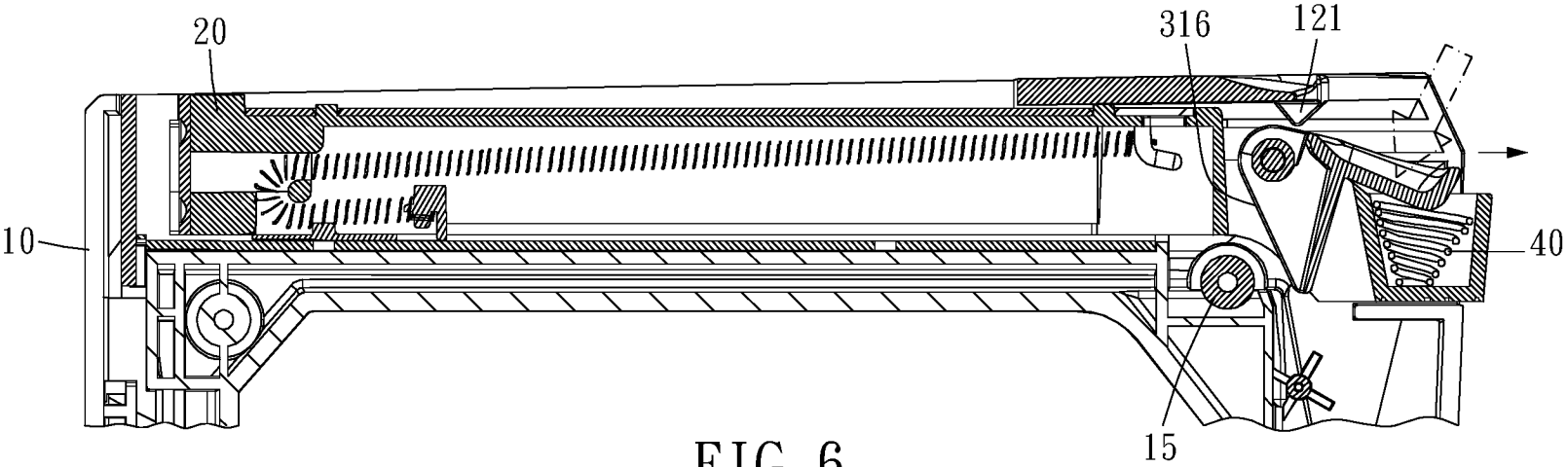
Figure 7:
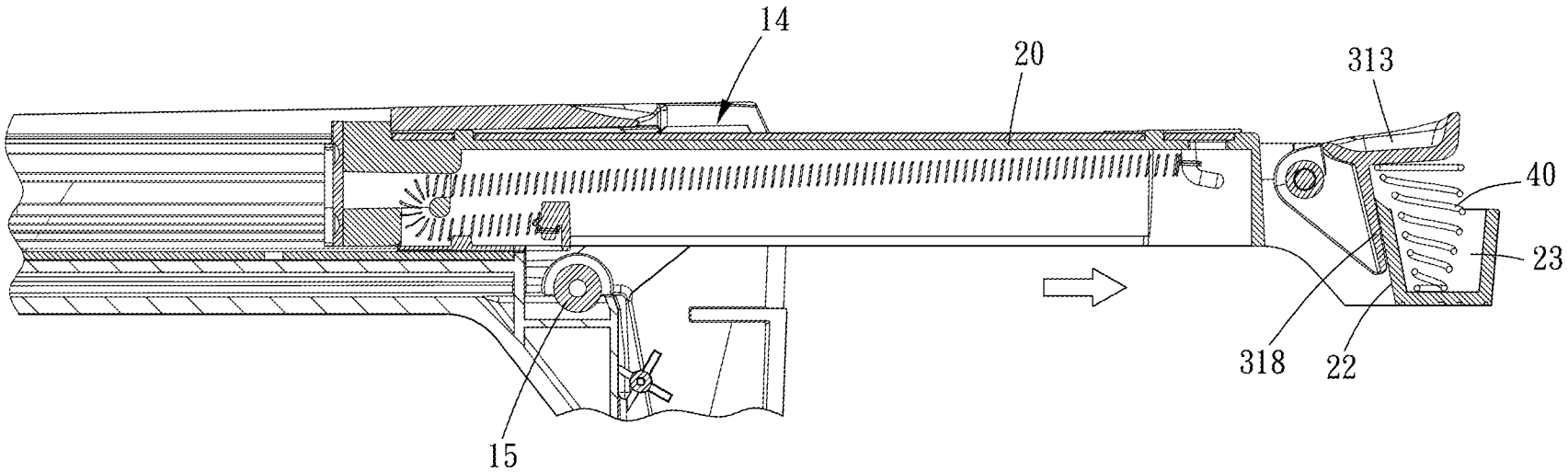

As shown in FIGS. 5-7, when the pressed member 31 is pressed toward the interior of the main body 10, the pressed member 31 depresses the elastic member 40 to move the restricting portion 311 to the releasing position, the urge portion 316 pushes the block portion 15 to push the staple magazine 20 to withdraw rearward from the main body 10, and the restricting portion 311 is pushed by the elastic member 40 to return to the restricting position, thus being easy to operate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A staple gun, including:

a main body, including a bottom side, and an abutting portion, a staple outlet and a notch which are disposed on the bottom side;

a staple magazine, being withdrawably received within the main body; and a lock mechanism, including a pressed member disposed on the staple magazine, the pressed member having a restricting portion which is movable between a restricting position and a releasing position;

wherein when the restricting portion is in the restricting position, the pressed member is located within the notch, the restricting portion is blocked with the abutting portion and the staple magazine is non-withdrawable from the main body;

wherein when the pressed member is pressed and moved toward an interior of the main body and the restricting portion is in the releasing position, the restricting portion is unlocked from the abutting portion and the staple magazine is withdrawable from the main body; and wherein the bottom side includes an outermost bottom wall having the staple outlet disposed therethrough, the notch includes a first opening side open in a direction away from the staple outlet and a second opening side open on the outermost bottom wall, staples exit the main body through the staple outlet in a staple direction, and the pressed member is partially exposed from the second opening side and is pressable through the second opening side to move in a direction opposite to the staple direction.

2. The staple gun of claim 1, wherein the abutting portion projects from an inner face of the bottom side.

3. The staple gun of claim 1, wherein the pressed member is rotatably attached to the staple magazine and further includes a push member exposed from the notch, the restricting portion extends beside an inner side of the bottom side, and the push member and the restricting portion are located on the same side relative to a pivot point of the pressed member.

4. The staple gun of claim 3, wherein the staple magazine further includes a wall therewithin, the pressed member further includes a stop portion, and when the restricting portion is located in the restricting position, the stop portion is abutted against the wall.

5. The staple gun of claim 3, wherein the pressed member further includes an urge portion extending oppositely to the push member, the interior of the main body further includes a block portion, the urge portion is located between the abutting portion and the block portion, and the block portion is located on a rotation path of the urge portion.

6. The staple gun of claim 5, wherein the urge portion includes two side walls disposed on two corresponding sides of the push member, and when the two side walls contact the block portion, the restricting portion is disengaged from the abutting portion.

7. The staple gun of claim 6, wherein the abutting portion projects from an inner face of the bottom side; the staple magazine further includes a wall therewithin, the pressed member further includes a stop portion, and when the restricting portion is located in the restricting position, the stop portion is abutted against the wall; the abutting portion includes two protrusions located at two corresponding sides of the staple magazine, and the restricting portion includes two recesses which are located at two corresponding sides of the pressed member and are engageable with the two protrusions; an elastic member is disposed between the staple magazine and the pressed member so that the restricting portion is normally located in the restricting position; the staple magazine further incudes a receiving room open toward the pressed member, the wall is disposed at an outer side of the receiving room which is adjacent to the stop portion, and the elastic member is received within the receiving room; the staple magazine includes a through channel; and the pressed member is rotatably disposed within the through channel.

8. The staple gun of claim 1, wherein the abutting portion includes two protrusions located at two corresponding sides of the staple magazine, and the restricting portion includes two recesses which are located at two corresponding sides of the pressed member and are engageable with the two protrusions.

9. The staple gun of claim 1, further including an elastic member disposed between the staple magazine and the pressed member so that the restricting portion is normally located in the restricting position.

10. The staple gun of claim 1, wherein the staple magazine includes a through channel, and the pressed member is rotatably disposed within the through channel.

* * * * *